US006568115B2

(12) United States Patent
Beretta

(10) Patent No.: US 6,568,115 B2
(45) Date of Patent: May 27, 2003

(54) EXTENDABLE END-PLATE FOR PISTOL MAGAZINES

(75) Inventor: Ugo Gussalli Beretta, Brescia (IT)

(73) Assignee: Fabbrica d'Armi Pietro Beretta S.p.A. (IT)

( * ) Notice: Subject to any disclaimer, the term of this patent is extended or adjusted under 35 U.S.C. 154(b) by 0 days.

(21) Appl. No.: 10/110,708

(22) PCT Filed: Jun. 7, 2001

(86) PCT No.: PCT/IT01/00291

§ 371 (c)(1),
(2), (4) Date: Jul. 30, 2002

(87) PCT Pub. No.: WO02/06749

PCT Pub. Date: Jan. 24, 2002

(65) Prior Publication Data

US 2003/0046850 A1 Mar. 13, 2003

(30) Foreign Application Priority Data

Jul. 14, 2000 (IT) ..... BS00A0066

(51) Int. Cl.[7] ..... F41A 9/61
(52) U.S. Cl. ..... 42/50; 42/7
(58) Field of Search ..... 42/50, 7, 49.01

(56) References Cited

U.S. PATENT DOCUMENTS

| | | | | | |
|---|---|---|---|---|---|
| 5,438,783 | A | * | 8/1995 | Sniezak et al. | 42/7 |
| 5,642,582 | A | * | 7/1997 | Grams | 42/50 |
| 5,651,204 | A | * | 7/1997 | Hulsey et al. | 42/50 |
| 5,906,065 | A | * | 5/1999 | Pearce | 42/50 |
| 2002/0029506 | A1 | * | 3/2002 | Wollmann | 42/50 |

* cited by examiner

*Primary Examiner*—J. Woodrow Eldred
(74) *Attorney, Agent, or Firm*—McGlew and Tuttle, P.C.

(57) ABSTRACT

This invention concerns an end plate (11) for an ammunition chamber (12) to be inserted into the handle of a pistol (13) from below. At the front, it consists of an extendable element (17) which moves between a retracted rest position, co-planar with and in line with the end plate, and an extended downwards position, in order to increase temporarily and deliberately the gripping surface area of the handle, at least in a front part of the latter.

13 Claims, 2 Drawing Sheets

EXTENDABLE END-PLATE FOR PISTOL MAGAZINES

This invention concerns the sector of pistols in general and refers in particular to an end plate for the pistol magazine.

Pistols have a handle or grip for holding and manipulating the arm with one hand, on the part of the user, and there is usually a magazine inserted into the handle from below for the ammunition.

In general, the magazine consists of a chamber closed at the bottom by an end plate which is flush with the bottom end of the pistol handle. The end plate is removable from the chamber and, for this purpose, there is a spring lever that rests against the end plate via a spring-bearing plate.

Some pistols, in order to restrict the overall dimensions when not in use, have a short stocky handle, with a limited surface area for gripping by the user.

In other words, the length of the handle is insufficient for placing all the fingers from the middle to the little finger of the hand holding the weapon, giving an insecure hold and use of the gun, especially when the hand is big.

In an attempt to overcome this inconvenience, a magazine end plate for pistols has been invented and used which has an integral appendix facing forward and curved at the bottom as a continuation of the front side of the handle, in such a way as to increase the surface area for holding and gripping with the fingers involved. However, the integration of the appendix with the end plate and, thereby, its rigidity, implies a permanent increase in the pistol dimensions, just as if the handle were longer, which contributes to resolving one aspect of the problem, namely the gripping surface area, but fails to meet the other requirement of an effective reduction in the pistol dimensions when it is not in use, or in the holster.

The aim of this invention is to resolve completely and definitively the problems mentioned above and which are linked to a pistol with a stocky handle, by means of an increase in the gripping surface area of the pistol handle, to give a correct and safe hold, but without any increase in the gun dimensions when it is not in use.

Another aim of the invention is to furnish an end plate for pistol magazines that can adopt two positions, one of reduced dimensions and one of increased gripping surface area of the handle, without modifying the usual common shape of the end plate, neither in its method of application to the magazine chamber nor in the shape of the chamber itself.

A further aim of the invention is to supply an end plate for the pistol magazine that can be used and mounted on a chamber, in the place of or as substitution for a normal end plate, and which extends, as needed, to increase the gripping surface area of the handle.

Said aims and the advantages that they imply are achieved, in accordance with the invention, using a magazine end plate which is inserted into the handle of a pistol, which consists of an extendable element that can move from a retracted rest position, which is co-planar and flush with the end plate, to a downwards extended position, to give a temporary increase of the gripping surface area of the handle.

The extendable element of the end plate normally remains in the retracted rest position and moves to the extended position after contact and pressing on the element itself by the little ringer of the hand holding the gun.

Greater detail of the invention will become evident from the following description, which is made with reference to the enclosed designs, which are indicative but not binding, in which.

Figure 6:
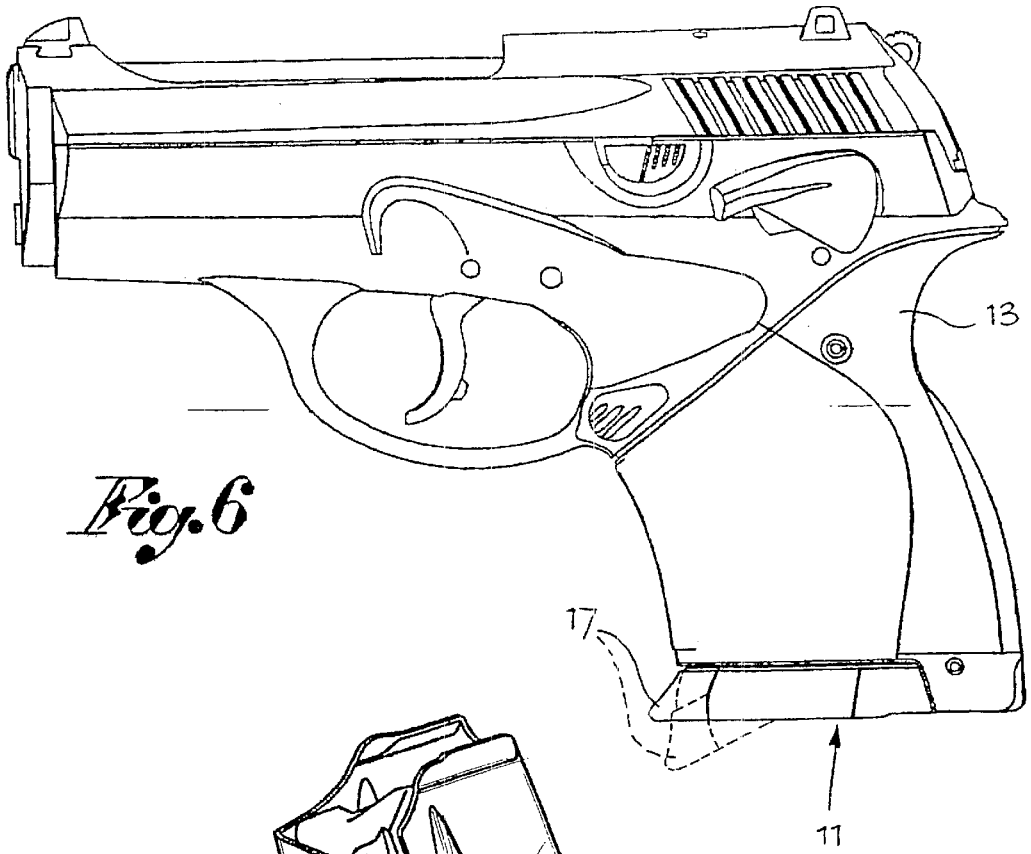
FIG. 6 shows a pistol complete with magazine, with the expendable element of the end plate in the retracted position and, with dotted lines indicating the extended position.
Figure 1:
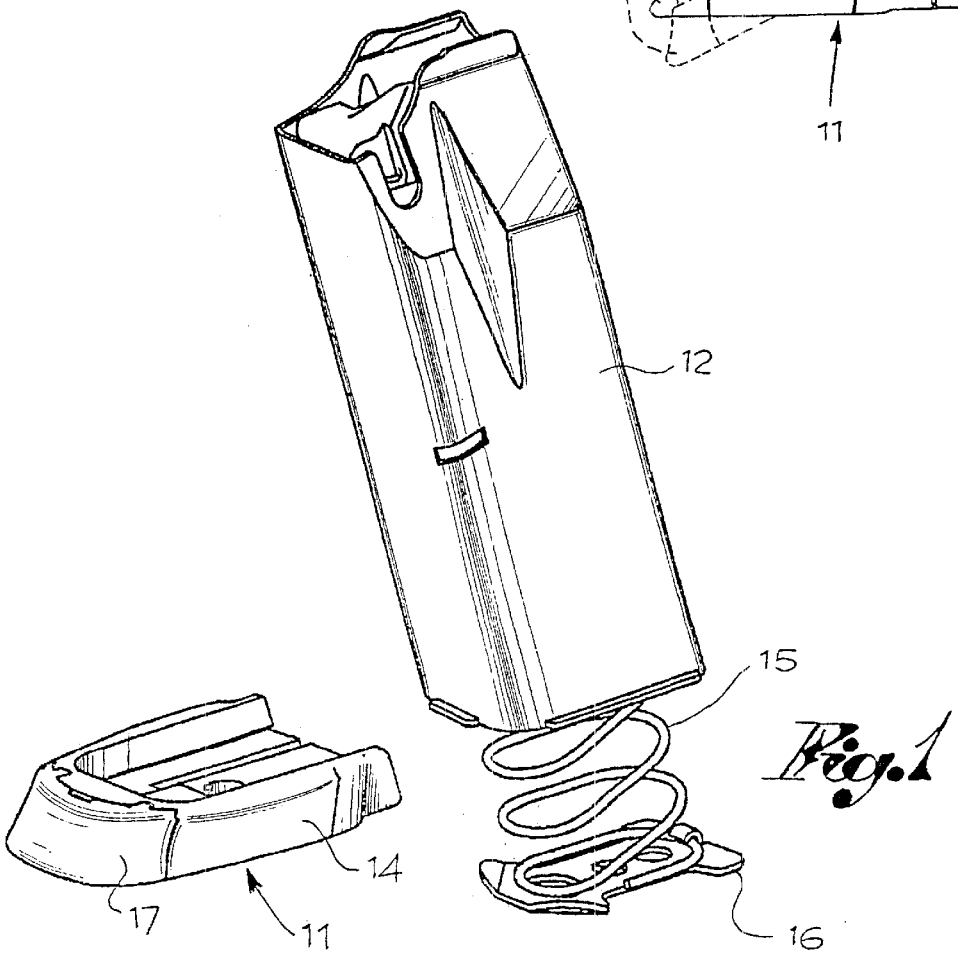
FIG. 1 shows the end plate detached from the chamber of a pistol magazine.

In said designs, the end plate of the invention is universally indicated with 11 and is applied to the chamber 12 of a magazine, to be inserted into the handle of a pistol 13. The end plate 11 has a body 14 immovably fixed to the bottom of the chamber 12 in the usual way, which is already well-known and not worth describing here. The chamber 12 has a lever (not shown) activated by a spring 15, fastened at its base to a spring-carrying plate 16 (where foreseen), which rests on the end plate 11 when this is applied to the chamber.

Figure 5:
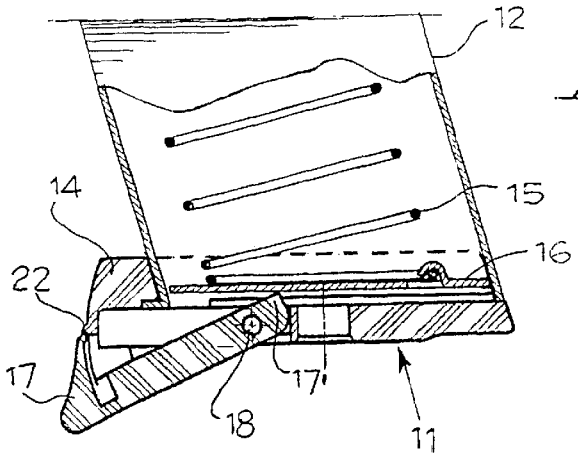
FIG. 5 shows a similar cross-section to FIG. 4, but with the extendable element in the outstretched position.
Figure 4:
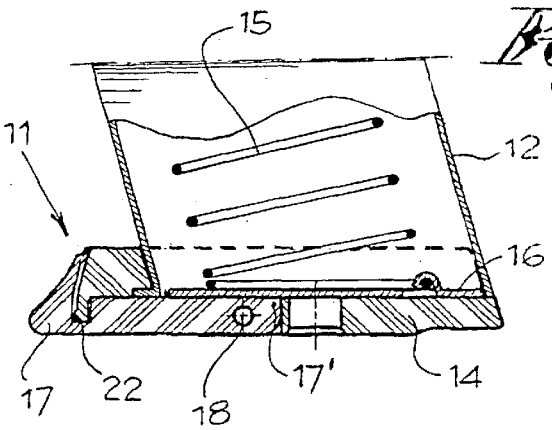
FIG. 4 shows a cross-section according to the arrows IV—IV in FIG. 2, with the expendable element retracted in the rest position.

The end plate 11 is equipped with an extendable element 17, placed ahead of and turned forwards, with respect to the end plate itself. Said extendable element 17 can move between a retracted rest position (FIG. 4), in which it is enclosed and hidden within the body of the end plate, and an extended downward position, ahead of the end plate, as a sort of prolongation of the front part of the pistol handle (FIGS. 5 and 6).

Figure 3:
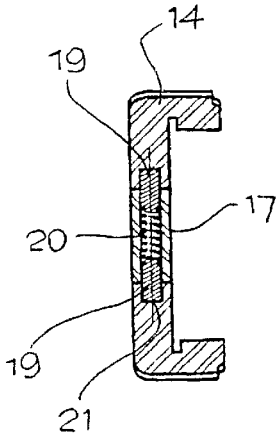
FIG. 3 shows a cross-section according to the arrows III—III in FIG. 2.
Figure 2:
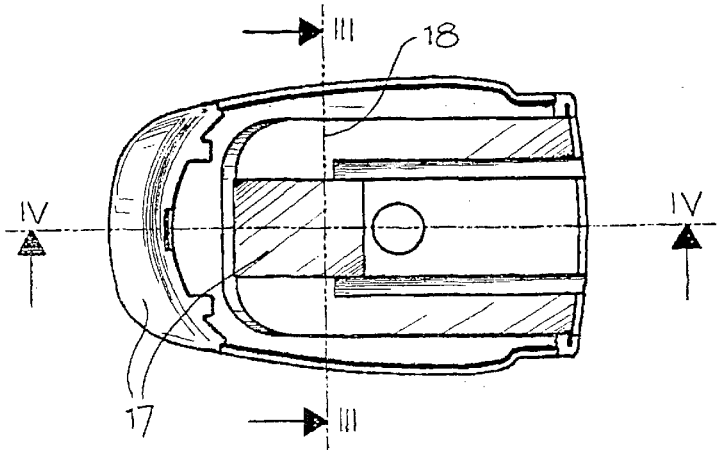
FIG. 2 shows a plan of the inside of the end plate.

On account of these movements, the extendable element 17 is mounted on the body of the end plate with an oscillating axis 18, consisting, in the version shown, of two facing pins 19 with an intermediate spring 20 and where the spring pushes the pins 19 so that they are housed in their respective holes 21 made in the body of the end plate, on opposite sides of the element 17 (FIG. 3).

The extendable element 17 normally remains in the retracted rest position (FIG. 4) in which it has no influence on the pistol dimensions (FIG. 6). The extendable element 17 is moved into the extended position (FIG. 5 and dotted lines in FIG. 6) when needed.

This follows the gripping of the handle with one hand and a contact and push downwards by the little finger on the extendable element, which then increases the surface area for gripping, as desired.

The extendable element 17 may return to its rest position automatically, thanks to the spring 15 in the chamber, once the hold on the handle is released when the gun is put away.

Alternatively, the body 14 of the end plate may be equipped with a catch 22, positioned to intercept, block and hold the extendable element 17 in the extended position. (FIG. 5), against the action of the spring 15. In this way, the extendable element is returned to its rest position by a deliberate movement of the hand.

What is claimed is:

1. An end plate for a magazine chamber to be inserted from below into a pistol handle, wherein said chamber contains a lever spring above a spring bearing plate that rests on the end plate, the end plate comprising: an extendable element that moves between a retracted rest position, co-planar with and following the line of the end plate, and an extended downward position, for a temporary deliberate increase of the gripping surface area of the handle, at least in a forward part of the latter.

2. An end plate according to claim 1, wherein said extendable element is situated in a front part of the end plate and facing forwards.

3. An end plate according to claim 1, wherein said extendable element oscillates around an oscillating axis between said rest and extended positions.

4. An end plate according to claim 3, wherein said extendable element has at least a tail part in contact with the spring-bearing plate, in such a way that the lever spring pushes and normally keeps the extendable element in the rest position, the extended position being caused by touching the extendable element with a finger of the band that is holding the pistol handle.

5. An end plate according to claim 1, further comprising a catch for intercepting the extendable element, in order to keep it in the extended position until it is returned to the rest position manually.

6. An end plate according to claim 2, wherein said extendable element oscillates around an oscillating axis between said rest and extended positions.

7. An end plate according to claim 6, wherein said extendable element has at least a tail part in contact with the spring-bearing plate, in such a way that the lever spring pushes and normally keeps the extendable element in the rest position, the extended position being caused by touching the extendable element with a finger of the band that is holding the pistol handle.

8. An end plate according to claim 2, further comprising a catch for intercepting the extendable element, in order to keep it in the extended position until it is returned to the rest position manually.

9. An end plate according to claim 3, further comprising a catch for intercepting the extendable element, in order to keep it in the extended position until it is returned to the rest position manually.

10. An end plate according to claim 4, further comprising a catch for intercepting the extendable element, in order to keep it in the extended position until it is returned to the rest position manually.

11. An end plate according to claim 6, further comprising a catch for intercepting the extendable element, in order to keep it in the extended position until it is returned to the rest position manually.

12. An end plate according to claim 7, further comprising a catch for intercepting the extendable element, in order to keep it in the extended position until it is returned to the rest position manually.

13. An end plate for a magazine chamber to be inserted from below into a pistol handle, wherein said chamber contains a lever spring bearing on the end plate, the end plate comprising: an extendable element that moves between a retracted rest position, co-planar with and following the line of the end plate, and an extended downward position, for a temporary deliberate increase of the gripping surface area of the handle, at least in a forward part of the latter.

* * * * *